United States Patent [19]

Johnson et al.

[11] Patent Number: 5,056,985

[45] Date of Patent: Oct. 15, 1991

[54] BACKHOE CONTROL MECHANISM

[75] Inventors: Russell I. Johnson, Leonard, Mich.; Garry L. Ball, Lancaster, Pa.; John O. Steinkamp, Milford, Mich.

[73] Assignee: Ford New Holland, Inc., New Holland, Pa.

[21] Appl. No.: 447,744

[22] Filed: Dec. 8, 1989

[51] Int. Cl.[5] ..... E02F 3/42

[52] U.S. Cl. ..... 414/694; 74/471 R; 74/481; 74/491; 74/525

[58] Field of Search ..... 414/694; 74/471 R, 491, 74/481, 586, 525, 522; 403/3

[56] References Cited

U.S. PATENT DOCUMENTS

| | | | |
|---|---|---|---|
| 3,752,337 | 8/1973 | Randolph et al. | 74/694 X |
| 4,019,401 | 4/1977 | Drone | 74/491 X |
| 4,397,336 | 8/1983 | Godfrey | 74/471 R X |
| 4,419,040 | 12/1983 | Pedersen et al. | 414/694 X |
| 4,736,647 | 4/1988 | Shimoie et al. | 74/471 R X |

*Primary Examiner*—Robert J. Spar
*Assistant Examiner*—Donald W. Underwood
*Attorney, Agent, or Firm*—Larry W. Miller; Frank A. Seemar; Darrell F. Marquette

[57] ABSTRACT

A control mechanism for operating a backhoe is disclosed wherein the controls are adaptable to be configured in a selected one of a two lever system, a three lever system, or a four lever system. The control mechanism includes a first pivot axis on which the control levers are pivotally mounted and a second pivot axis on which a series of bell cranks are pivotally mounted. Various linkages interconnect the control levers with the bell cranks, and the bell cranks with hydraulic valve spools in a manner in which the valve body does not have to be reconfigured depending upon which the control system is utilized. The control levers are configured with a pivot casting having a bent control rod threadably received therein, the position of which is fixed by a lock nut permitting the control handle to be positioned in the orientation desired by the operator.

5 Claims, 8 Drawing Sheets

6
5
78a
72
78
71
78a
78
74
73
79
77
76
75
90
92
83
81
82
91
79
81
92
12
94
89
88
87
86
93
61
62
63
64
66
67
60
39
30

78a
78
70
76
75
77
81
83
82
92
79
73
89
90
91
88
94
61
60
39

78a
78
72
79
76
75
81
82
83
88
77
70
74
90
89
60

BACKHOE CONTROL MECHANISM

BACKGROUND OF THE INVENTION

This invention relates generally to construction vehicles commonly referred to as tractor-loader-backhoes and, more particularly, to an improved control mechanism for operating the backhoe.

Backhoe control mechanisms have generally been configured in one of three standard orientations. A four lever control mechanism controls the four hydraulic functions of the backhoe assembly, i.e. lift, swing, bucket, and crowd, individually with each control lever effecting operation of one of the corresponding hydraulic cylinders. A three lever control mechanism utilizes foot pedal controls for the swing of the backhoe assembly, while the three remaining hydraulic functions are controlled through appropriate control levers. A two lever control system controls all four hydraulic functions through the two control levers with two functions being controlled through fore-and-aft movements of each respective control lever, and the remaining two functions being controlled through transverse movements of the control levers.

The control mechanism is associated with a valve body having a plurality of spools controlling the flow of hydraulic fluid to the hydraulic cylinders corresponding to each respective function of the backhoe assembly. Typically, each type of control mechanism described above has the spools oriented in a different configuration for proper alignment with the respective control member. Accordingly, conversion of a backhoe control mechanism from one type of system to another has been cumbersome and involves a restacking of the valve body. Accordingly, conversion of one type of control system to another has involved a significant amount of time and expense. A further complication lies in the orientation of the control handles of each different control system as the handles are positioned in a different location with each respective type of control mechanism.

Accordingly, it would be desirable to provide a backhoe control mechanism that would facilitate the conversion of one type of system to another for the convenience and comfort of the operator so that he may utilize the type of control mechanism with which he is accustomed.

SUMMARY OF THE INVENTION

It is an object of this invention to overcome the aforementioned disadvantages of the prior art by providing a control mechanism which can be easily converted from one type of system to another without effecting a restacking of the valve body.

It is a feature of this invention that the control mechanism includes a first pivot axis upon which the control levers are pivotally mounted and a second pivot axis on which a selected series of bell cranks can be supported to interconnect the pivotal movements of the control levers with the respective valve body spool.

It is an advantage of this invention that the backhoe control mechanism can be quickly and easily converted from one type of system to another.

It is another object of this invention to provide valve cranks pivotally mounted on a pivot shaft to interconnect by respective linkages with corresponding control levers and the hydraulic valve spools to permit the movement of the respective spool to be affected by the desired control lever.

It is another feature of this invention that the backhoe control mechanism can be converted from one type of system to another without reconfiguring the hydraulic valve body.

It is another advantage of this invention that the operator can easily configure the backhoe controls to the type of control mechanism with which he is accustomed.

It is still another object of this invention to provide a mounting of the control lever so that the control lever can be oriented in a selected configuration as desired by the operator.

It is still another feature of this invention that the control lever is constructed with a bend rod threadably received in a pivot casting which can be locked into a pre-selected position with a lock nut.

It is still another advantage of this invention that the control handles for the backhoe control mechanism can be repositioned quickly and easily.

It is a further object of this invention to provide a backhoe control mechanism which can be converted from one type of system to another without requiring a re-stacking of the hydraulic control valve body, which is durable in construction, inexpensive of manufacture, carefree of maintenance, facile in assemblage, and simple and effective in use.

These and other objects, features, and advantages are accomplished according to the instant invention by providing a control mechanism for operating a backhoe wherein the controls are adaptable to be configured in a selected one of a two lever system, a three lever system, or a four lever system. The control mechanism includes a first pivot axis on which the control levers are pivotally mounted and a second pivot axis on which a series of bell cranks are pivotally mounted. Various linkages interconnect the control levers with the bell cranks, and the bell cranks with hydraulic valve spools in a manner in which the valve body does not have to be reconfigured depending upon which control system is utilized. The control levers are configured with a pivot casting having a bent control rod threadably received therein, the position of which is fixed by a lock nut permitting the control handle to be positioned in the orientation desired by the operator.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
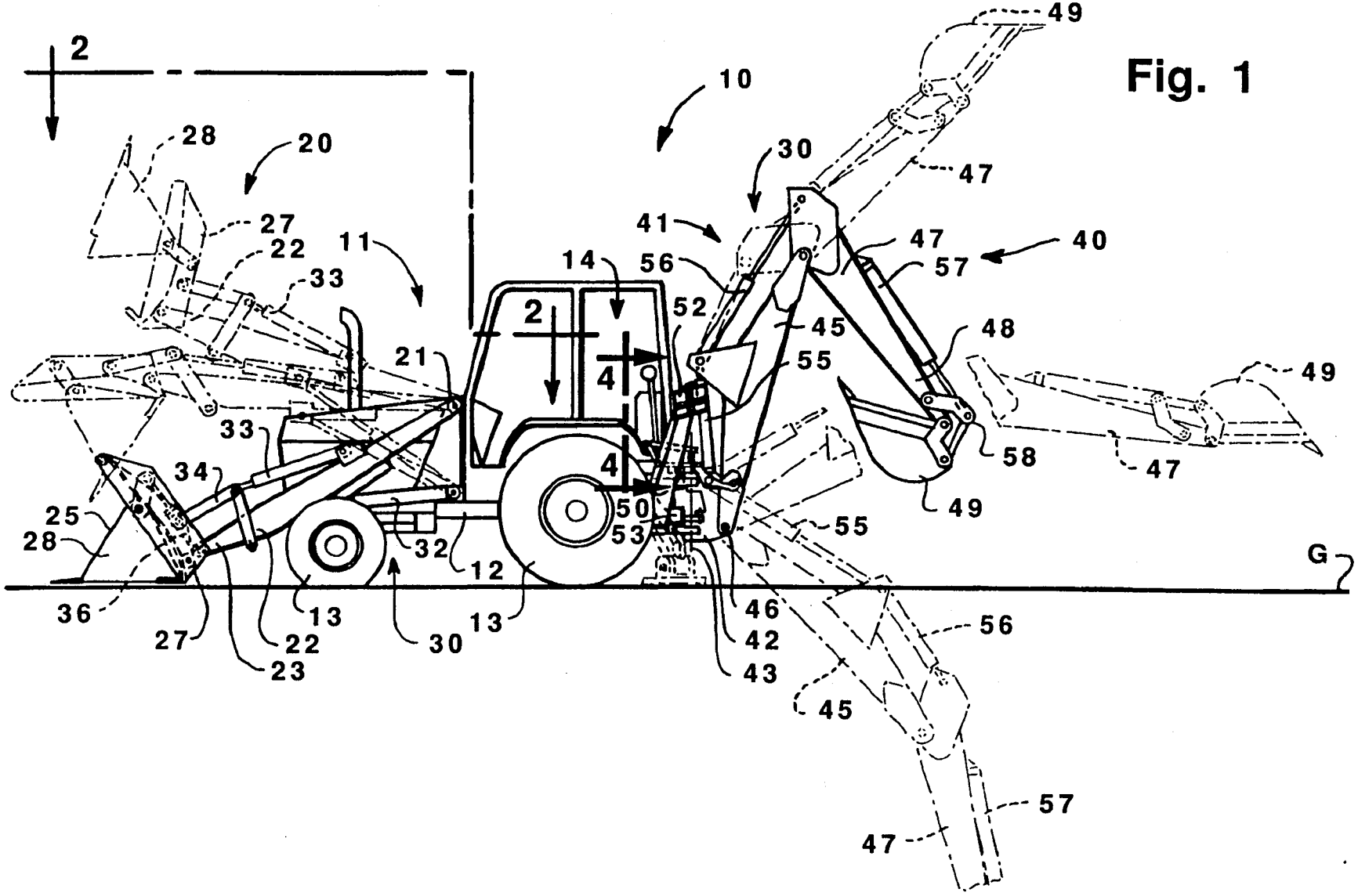
FIG. 1 is a side elevational view of a tractor-loader-backhoe incorporating the principles of the instant invention, the respective movements of the loader mechanism, articulated working tool, outrigger stabilizers, and backhoe mechanism being shown in phantom.

Referring now to the drawings and, particularly, to FIG. 1, a side elevational view of a tractor-loader-backhoe, commonly referred to as a TLB, incorporating the principles of the instant invention can be seen. Any left and right references are used as a matter of convenience and are determined by standing at the rear of the machine, facing the forward end, the direction of travel. The tractor-loader-backhoe 10 includes a prime mover 11 having a frame 12 provided with wheels 13 to permit mobile movement of the prime mover 11 over the ground G. The prime mover 11 is also provided with an operator's station 14 in which various operative controls are conveniently accessible to permit the operator to control the operable functions of the tractor-loader-backhoe 10.

Figure 2:
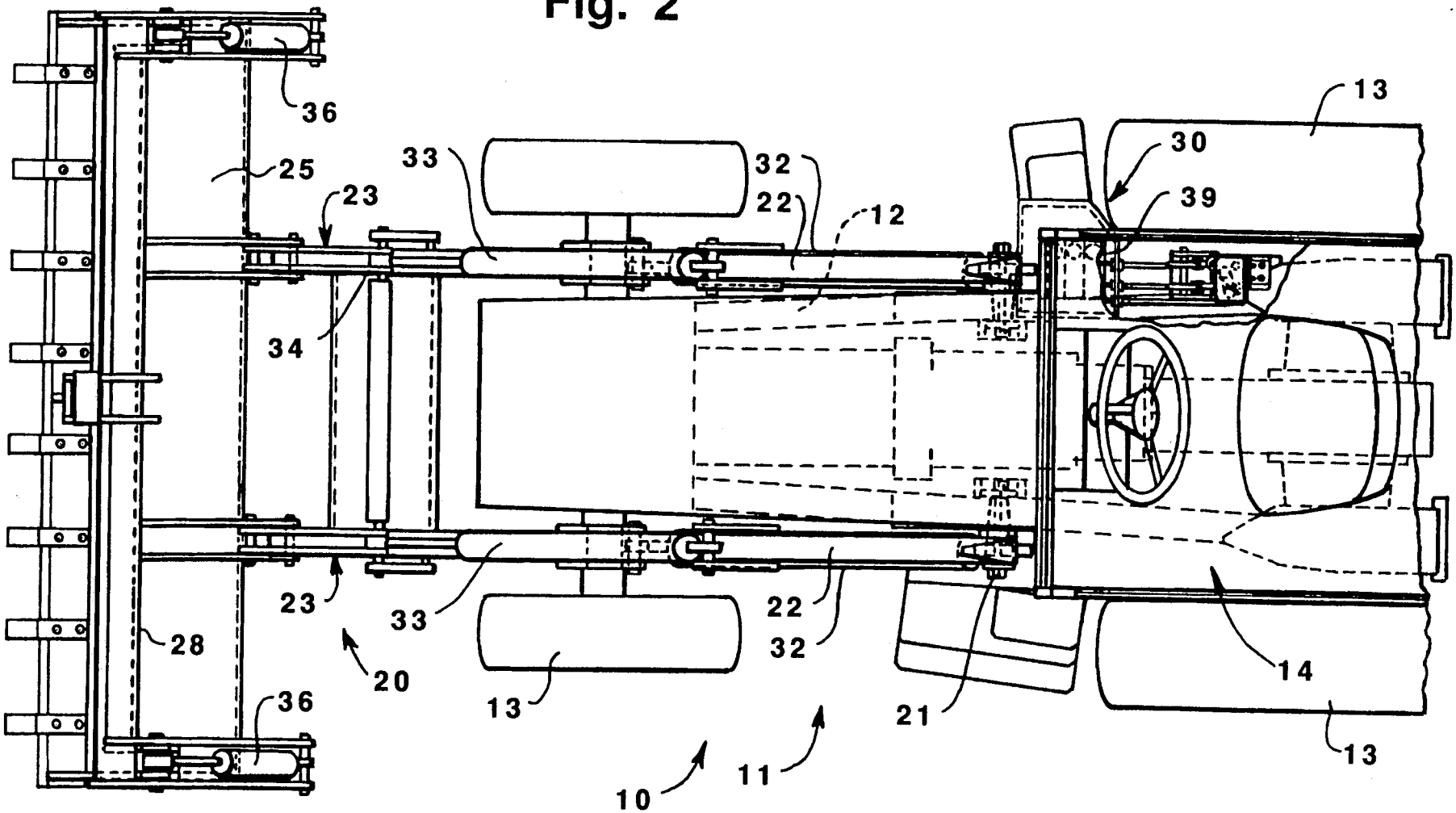
FIG. 2 is an enlarged top elevational view of the forward portion of the tractor-loader-backhoe shown in FIG. 1, corresponding to lines 2—2 of FIG. 1, to show the loader mechanism in greater detail.

As is best seen in FIGS. 1 and 2, the TLB 10 has a loader mechanism 20 mounted forwardly thereof for the handling of material. The loader mechanism 20 includes a pair of fore and aft extending loader arms 22 pivotally connected to the frame 12 for vertical movement, as shown in phantom in FIG. 1, about a generally horizontally extending axis 21, and a working tool 25 pivotally connected at the distal end 23 of the loader arms 22 for pivotal movement relative thereto, as is also shown in phantom in FIG. 1. The working tool 25, shown in FIGS. 1 and 2 as a bucket, can be capable of independent articulated movement, such as shown in the clam shell bucket in phantom in FIG. 1. Such buckets would include at least a base member 27 affixed to the loader arms 22 and a movable member 28 pivotally supported from the base member 27 to be movable relative thereto.

The prime mover 11 is provided with a conventional power source (not shown) including a hydraulic system 30 providing a source of hydraulic fluid under pressure to various hydraulic components carried by tractor-loader-backhoe 10. The hydraulic system 30 includes a pair of hydraulic cylinders 32 interconnecting the frame 12 of the prime mover 11 and the loader arms 22 to power the pivotal movement thereof about the horizontal axis 21. Similarly, a pair of co-acting hydraulic cylinders 33 interconnecting the loader arms 22 and a linkage 34 operably connected to the working tool 25 effects pivotal movement of the working tool 25 relative to the loader arms 22. For those machines 10 incorporating an articulated working tool 25, the hydraulic system 30 would also include a pair of transversely disposed co-acting hydraulic cylinders 36 interconnecting the base member 27 and the movable member 28 to effect articulation of the movable member 28 relative to the base member 27. Each hydraulic cylinder 32, 33, 36 would be provided with conventional plumbing connections (not shown) to provide hydraulic fluid under pressure thereto through a control valve 39 supported on the frame 12 adjacent the operator's compartment 14 to control the direction of flow of hydraulic fluid through the hydraulic system 30 in a conventional manner.

Figure 3:
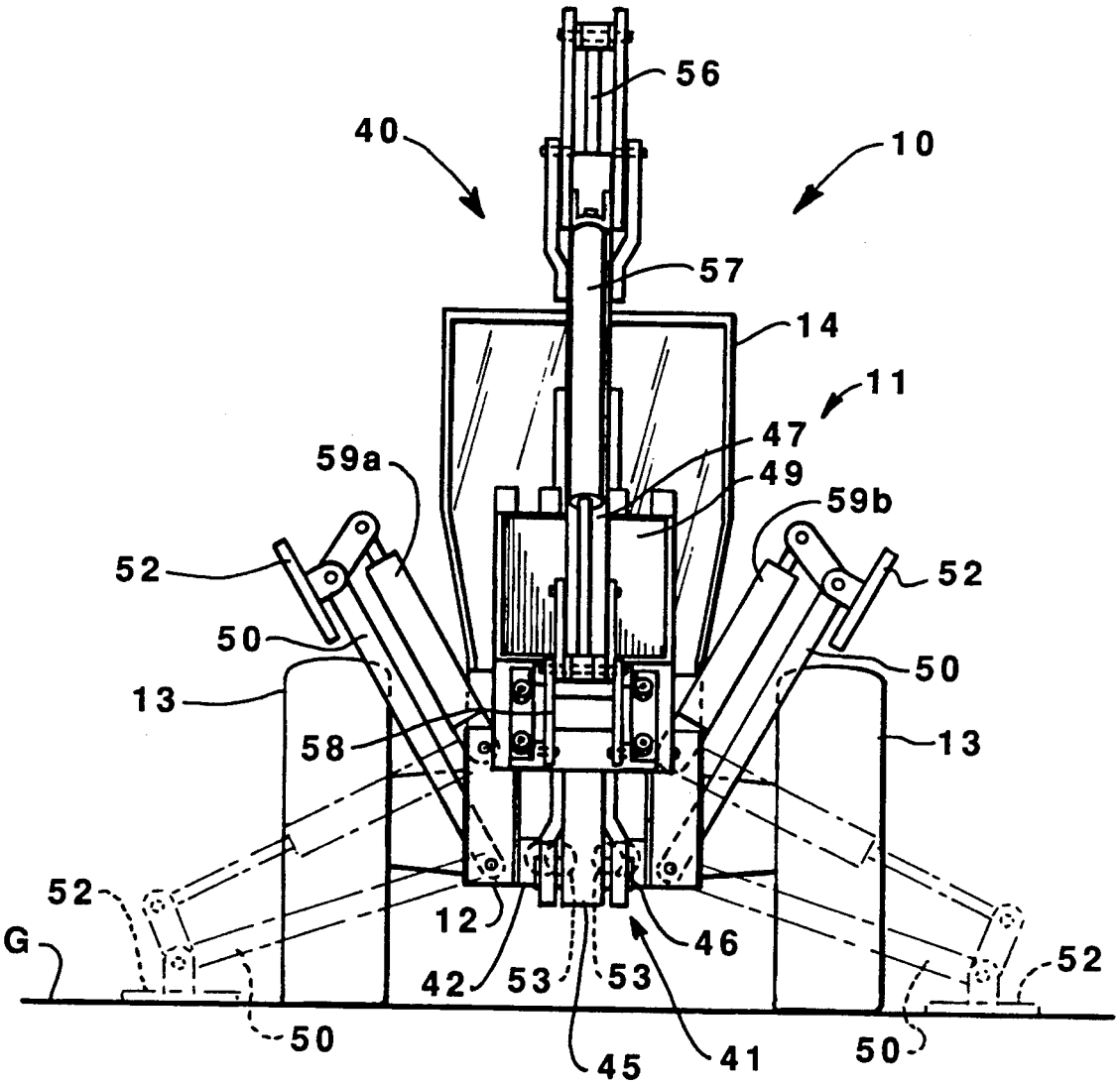
FIG. 3 is a rear elevational view of the tractor-loader-backhoe seen in FIG. 1, depicting the backhoe mechanism mounted thereon in a transport position, the pivotal movement of the outrigger stabilizers being shown in phantom.

Referring now to FIGS. 1 and 3, it can be seen that the tractor-loader-backhoe 10 is also provided with a backhoe mechanism 40 mounted at the rearward end of the prime mover 11 for pivotable operation in a known manner. The backhoe mechanism 40 includes a boom assembly 41 including a mounting member 42 pivotally connected to the frame 12 to permit pivotal movement of the boom assembly 41 about a generally vertically extending axis 43. The boom assembly 41 also includes a boom member 45 pivotally connected to the mounting member 42 for generally vertical movement about a horizontally extending axis 46 and a dipper member 47 pivotally connected to the boom member 45 for articulated movement relative thereto a common vertical plane therewith. The boom assembly 41 also includes a digging bucket 49 pivotally connected to the distal end 48 of the dipper member 47 for articulated movement relative thereto in a conventional manner.

When the backhoe mechanism 40 is being operated, a means for stabilizing the motion of the prime mover 11, i.e., to restrain rolling motion of the wheels 13, is customarily provided. The machine 10 is provided with a pair of laterally extending outrigger stabilizers 50 pivotally connected to the frame 12 of the prime mover 11 for movement between an elevated transport position, shown in solid lines in FIG. 3, and a ground engaging position, shown in phantom in FIG. 3. Each outrigger stabilizer 50 is provided with a ground engaging shoe 52 which can be constructed in a number of configurations to complement the surface of the ground G to be engaged. By sufficient downward pressure of the loader mechanism 20 and the outrigger stabilizers 50, the prime mover 11 can be elevated to the extent that the wheels 13 are not engaged with the ground G during operation of the backhoe mechanism 40.

To power the operation of the backhoe mechanism 40 and the outrigger stabilizers 50, the hydraulic system 30 is also provided with swing cylinders 53 interconnecting the frame 12 of the prime mover 11 and the mounting member 42 to effect pivotal movement thereof in a generally horizontal plane about the vertical axis 43. The hydraulic system 30 also includes a boom cylinder 55 interconnecting the mounting member 42 and the boom member 45 to power the vertical movement of the boom member 45, dipper member 47, and bucket 49 about the horizontal axis 46. The hydraulic system 30 also includes a dipper cylinder 56 interconnecting the boom member 45 and the dipper member 47, as well as a bucket cylinder 57 interconnecting the dipper member 47 and the bucket 49 through a conventional connecting linkage 58. Each outrigger stabilizer 50 is provided with an individually operable cylinder 59*a*, 59*b* to permit level stabilization of the prime mover 11 on sloping ground, as is conventionally known. Each hydraulic cylinder 53, 55, 56, 57, 59*a*, and 59*b* are independently operable through a conventional control mechanism located in the operator's compartment 14 and described in greater detail below.

Customarily, the backhoe mechanism 40 is operable, through appropriate manipulation of the hydraulic system 30, to dig at an elevation lower than the surface of the ground G in which the prime mover 11 is positioned, as shown in phantom in FIG. 1. The backhoe mechanism 40 can be articulated into a compact transport position shown in FIGS. 1 and 3, centrally located relative to the line of travel of the prime mover 11, for transport thereof over the ground G. When the backhoe mechanism 40 is placed into this transport position, the boom cylinder 55 is completely collapsed to a fully retracted position, while the dipper cylinder 56 and the bucket cylinder 57 are extended. In addition, the transportation of the machine 10 over the ground G requires a raising of the outrigger stabilizers 50 to the transport position which results in a complete retraction of the associated hydraulic cylinders 59*a*, 59*b*.

Figure 4:
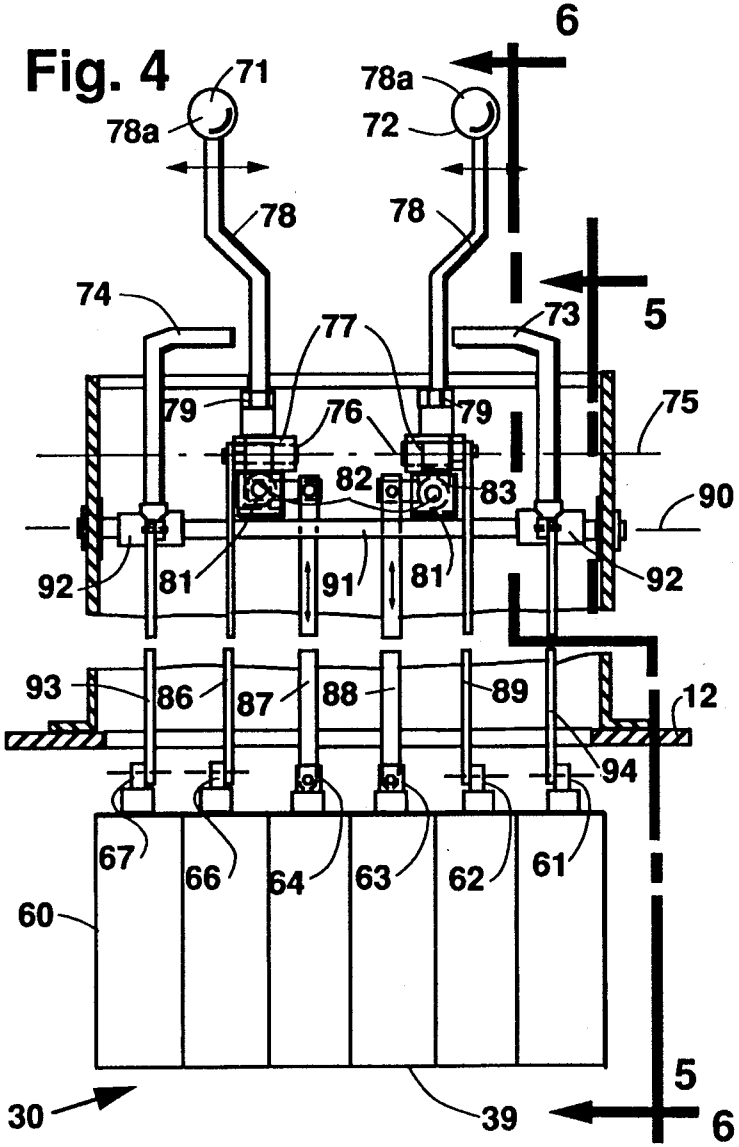
FIG. 4 is a front elevational view of the backhoe control mechanism configured in a two lever control system, corresponding to a cross-sectional view taken along lines 4—4 of FIG. 1.
Figure 5:
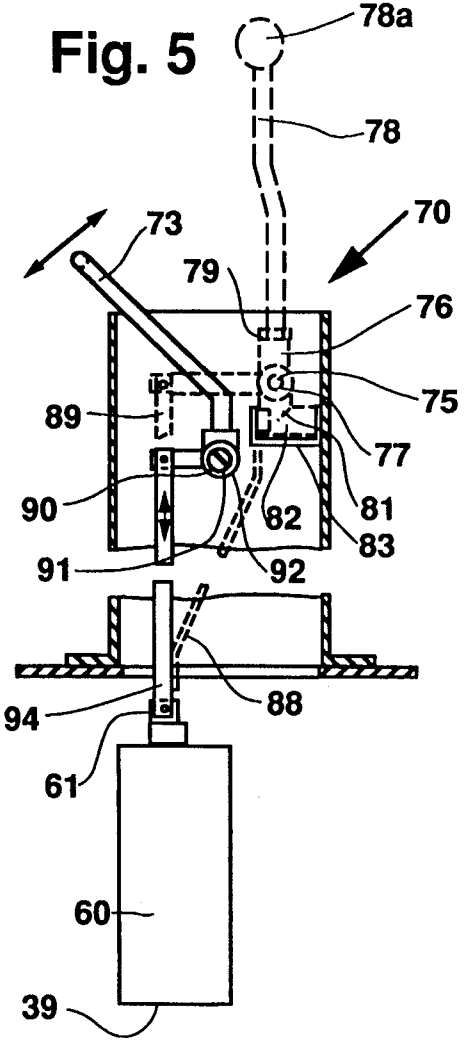
FIG. 5 is a cross-sectional detail view of the two lever control mechanism taken along lines 5—5 of FIG. 4 to show the outrigger stabilizer control linkage, some of the background connecting linkage being shown in phantom.
Figure 6:
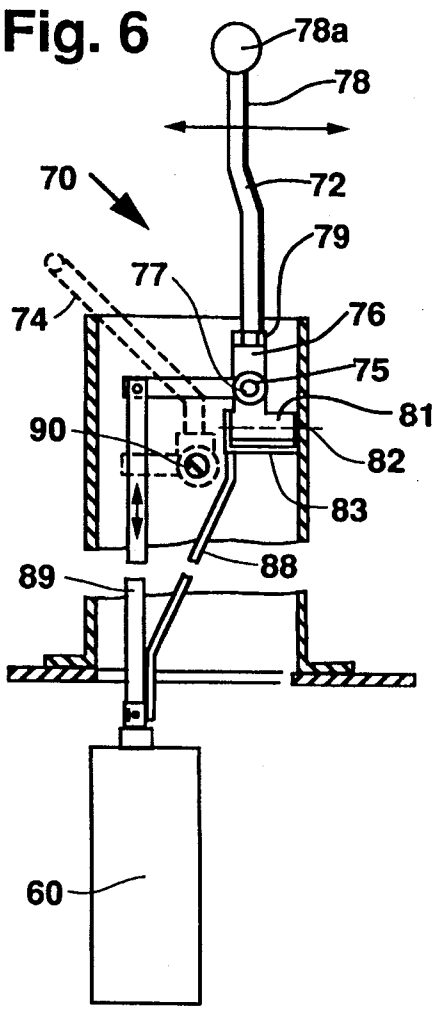
FIG. 6 is a cross-sectional detail view of the two lever control mechanism taken along lines 6—6 of FIG. 4 with the outrigger stabilizer control levers being shown in phantom.
Figure 7:
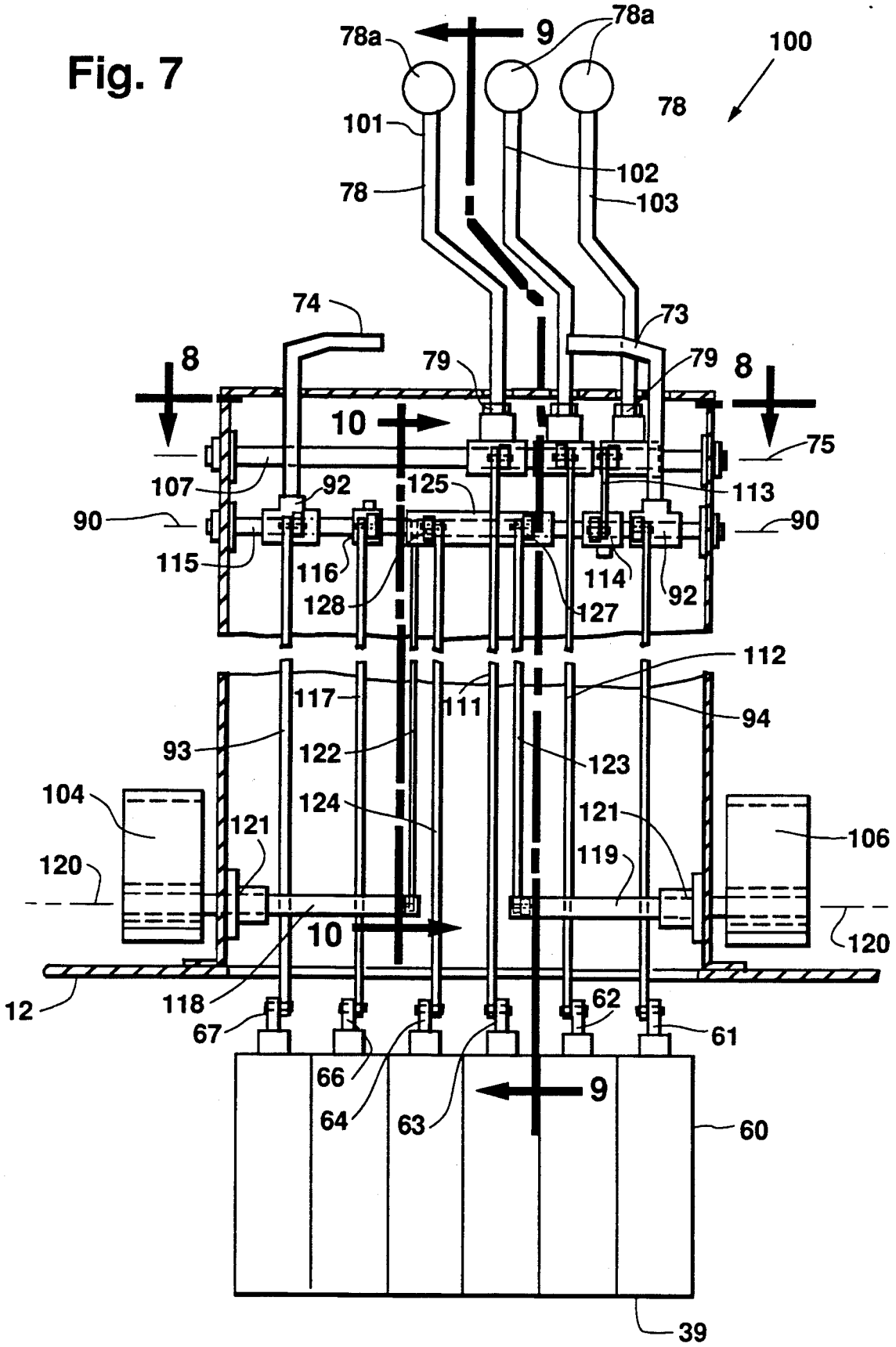
FIG. 7 is a front elevational view of the backhoe control mechanism configured in a three lever control system, corresponding to a cross-sectional view taken along lines 4—4 of FIG. 1.
Figure 8:
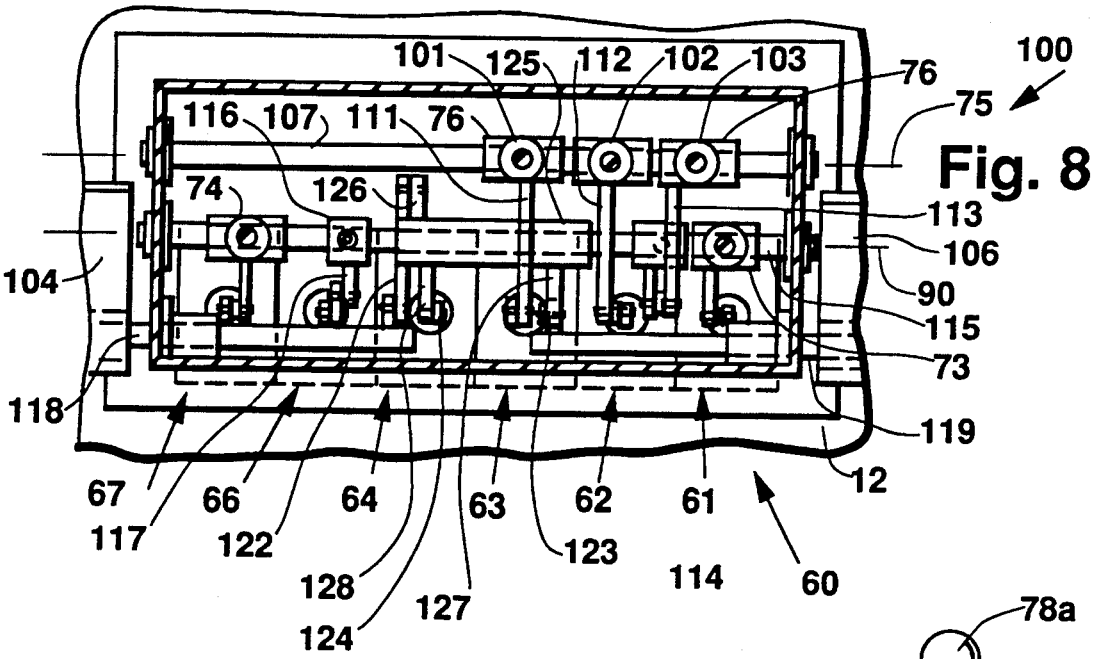
FIG. 8 is a cross-sectional detail view of the three lever control mechanism taken along lines 8—8 of FIG. 7 to show a top plan view of the three lever control mechanism with some of the deleted control linkage being shown in phantom.
Figure 10:
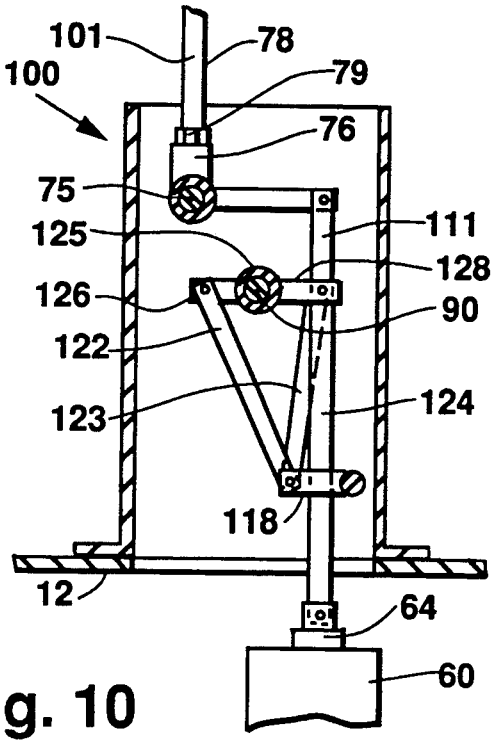
FIG. 10 is a cross-sectional detail view of the three lever control mechanism taken along lines 10—10 of FIG. 7 looking in the opposite direction to that of FIG. 9 to clarify the control linkage shown therein.
Figure 9:
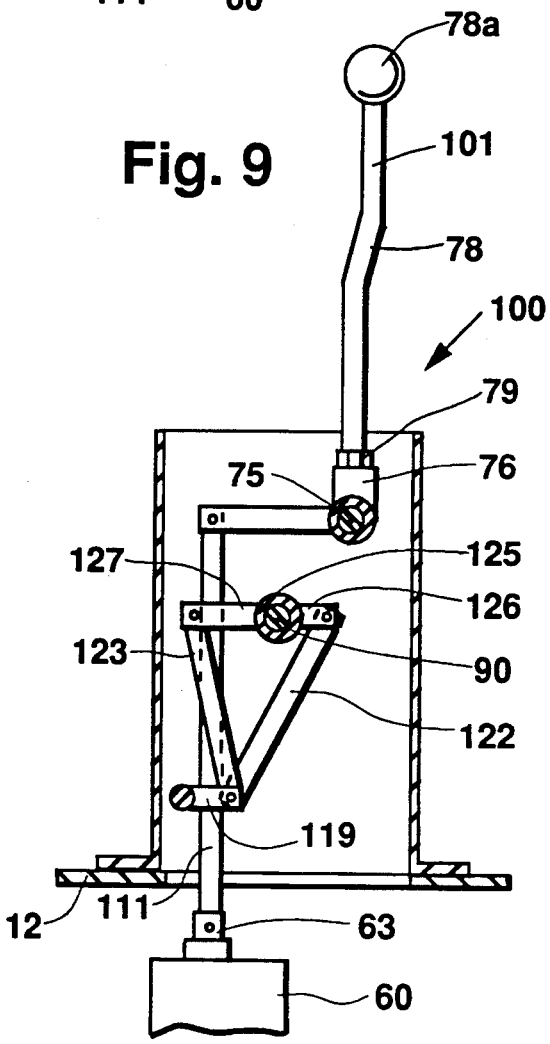
FIG. 9 is a cross-sectional detail view of the three lever control mechanism taken along lines 9—9 of FIG. 7.
Figures 11, 12, 13, 14:
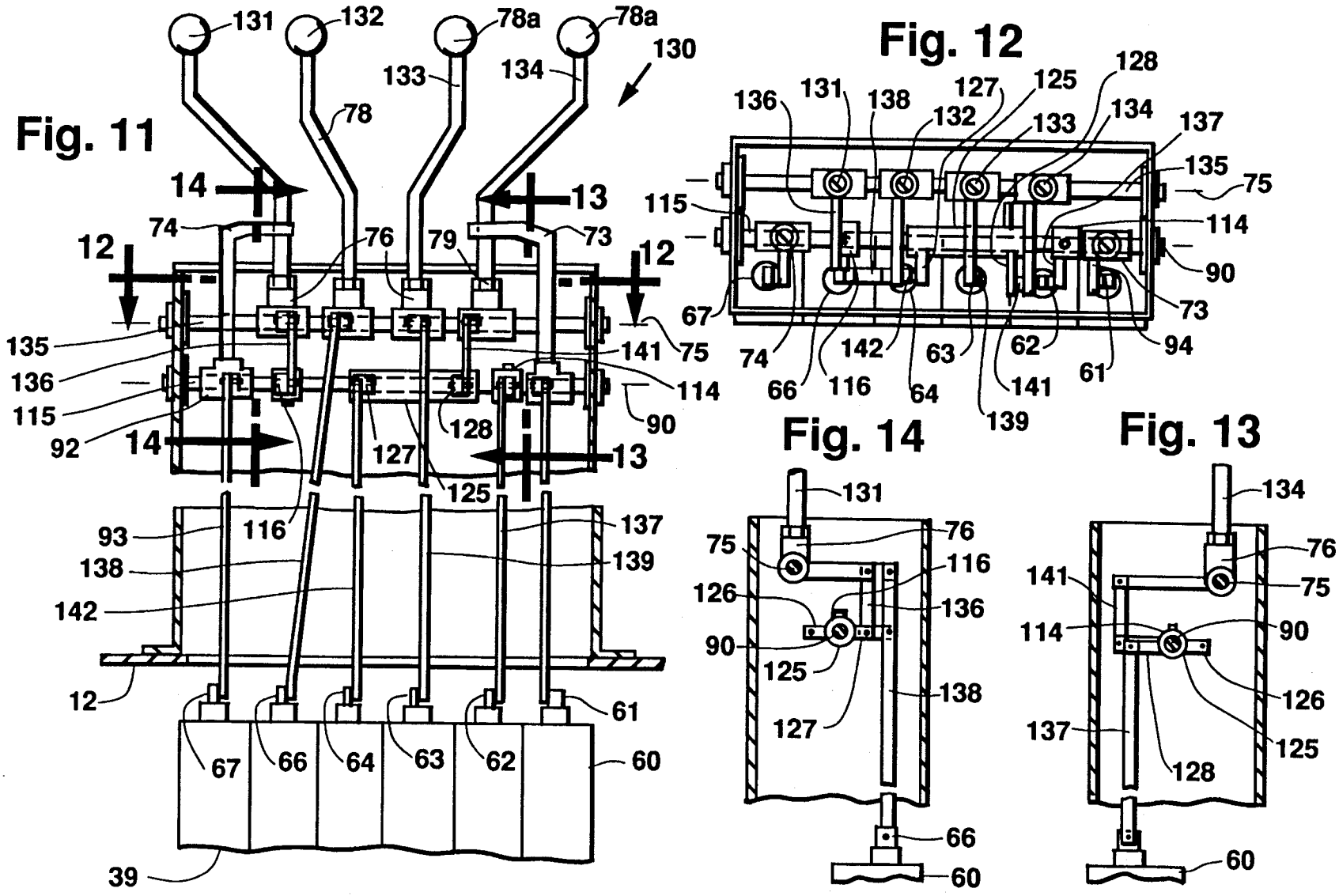
FIG. 11 is a front elevational view of the backhoe control mechanism configured in a four lever control system, corresponding to the cross-sectional view taken along lines 4—4 of FIG. 1.
FIG. 12 is a cross-sectional detail view of the four lever control mechanism taken along lines 12—12 of FIG. 11 to show a top plan view of the four lever control mechanism.
FIG. 13 is a cross-sectional detail view of the four lever control mechanism taken along lines 13—13 of FIG. 11 with some of the background connecting linkage being shown in phantom.
FIG. 14 is a cross-sectional detail view of the four lever control mechanism taken along lines 14—14 of FIG. 11.

Referring now to FIGS. 4–6, the details of the backhoe control mechanism configured in a two lever type of system can best be seen. It will be noted by one skilled in the art that the view of FIG. 4, as well as that of FIGS. 7 and 11, depict the control mechanism as seen from the operator's compartment 14 looking rearwardly toward the backhoe mechanism 40. The valve body 60 is configured such that spool 61 controls flow of hydraulic fluid to the left outrigger cylinder 59*a*, spool 62 controls the flow of hydraulic fluid to the dipper cylinder 56 (sometimes referred to as the crowd cylinder), spool 63 controls the flow of hydraulic fluid to the bucket cylinder 57, spool 64 controls the flow of hydraulic fluid to the swing cylinders 53, spool 66 controls the flow of hydraulic fluid to the boom cylinder 55 to effect a lifting or lowering of the boom assembly 41, and spool 67 controls the flow of hydraulic fluid to the right outrigger stabilizer cylinder 59*b*. It will be noted that this valve body 61 configuration remains constant with respect to all three configurations of the backhoe control mechanism 70 in FIGS. 4–14.

The two lever control mechanism shown in FIGS. 4–6 utilizes first and second control levers 71, 72, respectively, movable in both longitudinal and transverse directions to control movement of the spools of the valve body 60. The control mechanism 70 is also provided with first and second stabilizer control levers 73, 74, respectively, connected directly to spools 61, 67 to effect operation of the outrigger cylinders 59*a*, 59*b*.

Each of the control levers 71, 72 includes a pivot casting 76 pivotally mounted on a corresponding pivot shaft 77 for pivotal movement thereof about a first pivot axis 75. A bent control rod 78 topped by a handle 78*a* is threadably received within the pivot casting 76 and locked into a pre-selected rotated position by a lock nut 79.

The pivot casting 76 is pivotally supported from a supplemental pivot casting 81 which in turn is mounted on a pivot shaft 82 supported by a bracket 83 affixed relative to the frame 12. As a result, each control lever 71, 72, is pivotable about the first pivot axis 75 on the first pivot shaft 77, permitting longitudinal movement of the control lever 71, 72, and is pivotable about the second pivot shaft 82, permitting transverse movement of the control lever 71, 72.

The valve body 60 is mechanically connected directly to the pivot castings 76, 81 so that the pivotal movements of the control levers 71, 72 will effect respective movements of the spools 62–66. The first pivot casting 76 of the first control lever 71 is connected to spool 66 by a link member 86 so that the longitudinal pivotal movement of the first control lever 71 will effect a movement of the spool 66. The supplemental pivot casting 81 of the first control lever 71 is connected directly to the spool 64 by the link 87 so that a transverse pivotal movement of the first control lever 71 will effect a linear movement of the spool 64. Similarly, the second control lever 72 effects movement of the spool 63 by a link 88 connected to the supplemental pivot casting 81 associated therewith, and effects a movement of the spool 62 by a link 89 interconnecting the spool 62 and the pivot casting 76 of the second control lever 72.

The left and right stabilizer control lever 73, 74 are mounted on a pivot shaft 91 defining a second pivotal axis 90 supported on the frame 12 below the first pivot axis 75. The stabilizer control levers 73, 74 also include a pivot casting 92 pivotally mounted on the pivot shaft 91 and are connected directly to the respective spools 61, 67 by links 93, 94, respectively. It will be noted that in each of the configurations represented in FIGS. 4–14, the stabilizer control levers 73, 74 and associated linkage 93, 94 interconnecting the corresponding pivot casting 92 and the outrigger stabilizer spools 61, 67 are identical.

Referring now to FIGS. 7–10, the three lever backhoe control mechanism 100 can best be seen. As noted above, the valve body 60 remains unchanged from that depicted with respect to the two lever backhoe control mechanism 70 above. The arrangement of spools 61–67 controlling the operable functions of the backhoe mechanism 40 remain in the same configuration. The three lever control mechanism 100 includes three control levers 101, 102, 103 operably controlling the movements of the bucket cylinder 57, the dipper cylinder 56, and the boom cylinder 55, respectively. The swing function of the backhoe mechanism 40 effected by operation of the swing cylinders 53 is controlled by pedals 104, 106.

The control levers 101, 102, 103 are pivotally mounted on a pivot shaft 107 supported from the frame 12 to define the first pivot axis 75 for the control mechanism 100. As described above relative to the two lever control mechanism 70, each control lever 101, 102, 103 includes a pivot casting 76 pivotally mounted on the pivot shaft 107 and threadably receiving a bent control rod 78 which is locked into a pre-selected position by a lock nut 79. The first control lever 101 is connected directly by link 111 interconnecting the associated pivot casting 76 and the spool 63 for control of the bucket cylinder 57. Similarly, the second control lever 102 is connected by link 112 interconnecting the associated pivot casting 76 and the spool 62 to control operation of the dipper cylinder 56.

The third control lever 103 is used to control the boom cylinder 55. However, the traditional location of the boom control lever 103 in a conventional three lever backhoe control mechanism 100 is positioned on the right hand side (facing rearwardly toward the backhoe mechanism 40), while the spool 66 associated with the boom cylinder 55 is physically positioned near the left side of the valve body 60. To effect operation between the control lever 103 and the spool 66, the pivot casting 76 associated with the control lever 103 is connected to a link 113 which in turn is fastened to a pivot arm 114 affixed to the pivot shaft 115 defining the second pivot axis 90 for the three lever control mechanism 100, so as to be movable therewith.

A second pivot arm 116 is also affixed to the pivot shaft 115 in a position spaced transversely along the length of the pivot shaft 115 and positioned above the spool 66. A link 117 interconnects the second pivot arm 116 and the spool 66 to complete the linkage between the control lever 103 and spool 66. Accordingly, longitudinal movement of the control lever 103 will effect a pivotal movement of the first pivot arm 114 and a corresponding rotation of the pivot shaft 115 due to the fixation between the pivot arm 114 and the shaft 115. Since the second pivot arm 116 is also connected to the pivot shaft 115, the result in rotation moves the link 117 and the spool 66.

The generally horizontal swinging movement of the backhoe mechanism 40 is controlled through manipulation of the foot pedals 104, 106. The left foot pedal 104 is affixed to a pivot shaft 118 while the right foot pedal 106 is affixed to a second pivot shaft 119 for rotational movement therewith. Both the pivot shafts 118, 119 are mounted for pivotal movement on a support shaft 121 defining a third pivot axis 120. A bell crank 125 is rotatably mounted on the pivot shaft 115 between the pivot arms 114 and 116 for rotational movement relative to the shaft 115. The bell crank 125 includes a rearwardly projecting leg 126 and two forwardly projecting legs 127, 128. The pivot shaft 118 associated with the left foot pedal 104 is connected to the rearward leg 126 by a link 122. Similarly, the pivot shaft 119 associated with the right foot pedal 106 is connected to the first forwardly projecting leg 127 of the bell crank 125 by a link 123. The second forwardly projecting link 128 is connected to the spool 64 by a third link 124.

In operation, the depressing of the foot pedal 104 effects rotation of the pivot shaft 118 and a downward movement of the rearward leg 126 due to the connection by the link 122. As a result, the spool 64 is pulled upwardly by the link 124 connected to the forwardly extending leg 128. Conversely, a depressing of the right foot pedal 106 effects a rotational movement of the associated pivot shaft 119 and a downward movement of the forwardly projecting leg 127 due to the connection of the link 123, resulting in a likewise downward movement of the opposing forwardly projecting leg 128 and a downward shifting of the spool 64 due to the connection thereof with the link 124. Accordingly, manipulation of the backhoe swing cylinders 53 can be accomplished through manipulation of the foot pedals 104, 106.

It can be seen then, with the imposition of additional linkage members pivotally mounted for movement about the second pivot axis 90, such as the bell crank 125, the first and second pivot arms 114, 116, and associated links, along with the traditional mounting of three control levers 101, 102, 103 for pivotal movement about the first pivot axis 75, that the control mechanism for the backhoe mechanism 40 can be converted from a two lever control 70 to a three lever control 100. Since the reorganization of the hydraulic valve body 60 is not required, nor is there any need to relocate pivot axes, the addition of appropriate linkage members will permit a relatively quick conversion of the control mechanism from a two lever system 70 to a three lever system 100.

Referring now to FIGS. 11–14, a four lever backhoe control mechanism 130 can best be seen. The four lever control mechanism 130 includes four upwardly extending control levers 131, 132, 133, and 134, respectively, which are mounted for pivotal movement on a pivot shaft 135 defining the first pivot axis 75. The construction of each control lever 131–134 is substantially identical to that described above with a pivot casting 76 threadably receiving a bent control rod 78 locked into a preselected rotated position by lock nut 79. As with the two lever control mechanism 70 and the three lever control mechanism 100, the valve body 60 remains in the same configuration.

It will be noted that the location of the control levers 131–134 operably controlling the operation of the backhoe mechanism 40 is in a different orientation than that described above with respect to either the two lever backhoe control mechanism 70 or the three lever control mechanism 100, as the left control lever 131 is used to operably control the dipper cylinder 56, the left middle control lever 132 is used to operate the boom cylinder 55, the right middle control lever 133 operates the bucket cylinder 57, and the right control lever 134 controls operation of the swing cylinder 53.

Operational control of the valve body 60 is effected through orientation of the linkage members mounted on the pivot shaft 115 in a manner described in greater detail below. The stabilizer control levers 73, 74 are also mounted on the pivot shaft 115 and connected directly to the corresponding spools 61, 67 as described above by links 93, 94.

The second pivot arm 116 is positioned immediately below the first control lever 131 and is affixed to the pivot shaft 115 to be rotatable therewith. A link 136 interconnects the second pivot arm 116 and the pivot casting 76 associated with the left control lever 131. The first pivot arm 114 is also affixed to the pivot shaft 115 to be rotatable in unisom with the second pivot arm 116. A link 137 interconnects the first pivot arm 114 and the spool 62 associated with the dipper cylinder 56. As described above with respect to the boom control lever 103, a fore-and-aft movement of the left control lever 131 effects a linear movement of the spool 62 to control the crowd movement of the backhoe mechanism 40 effected by the dipper cylinder 56.

Both the middle control levers 132, 133 are connected directly to the associated spool 66, 64 by links 138, 139, respectively. Accordingly, fore-and-aft movement of the left middle control lever 132 effects operational movement of the boom cylinder 55 through the associated spool 66, while a corresponding fore-and-aft movement of the right middle control lever 133 similarly effects operational movement of the bucket cylinder 57 through the associated spool 63.

The right control lever 134 is used to control the operation of the swing cylinders 53; however, the spool 64 associated therewith is located near the center of the valve body 60. To effect the operational control between the control lever 134 and the spool 64, the pivot casting 76 corresponding to the right control lever 134 is connected to the forwardly extending leg 128 of the bell crank 125 pivotally mounted on the pivot shaft 115 for independent movement relative to the pivot shaft 115 by a first link 141. A second link 142 interconnects the second forwardly extending leg 127 of the bell crank 125 with the spool 64. The transverse spacing between the forwardly extending legs 127 and 128 accomodates the transverse spacing difference between the location of the right control lever 134 and the spool 64. In operation, a fore-and-aft movement of the right control lever 134 effects a rotation of the bell crank 125 and a corresponding linear movement of the spool 64.

One skilled in the art will readily realize that the mounting of the control levers 131–134 on the pivot shaft 135 for pivotal movement thereof about the first pivot axis 75 coupled with the rearrangement of the linkage components pivotally associated with the second pivot axis 90 will permit the conversion of the three lever backhoe control mechanism 100 to a four lever control mechanism 130. Since the reorganization of the valve body 60 is unnecessary, requiring only a reorientation of the various linkage components and a mounting of the additional levers on the pivot shaft 135, the conversion of the backhoe control mechanism into a four lever system 130 can be relatively quickly and easily accomplished. Furthermore, most of the linkage components required in any of the backhoe control mechanisms 70, 100, 130, are common to each of these systems, such that only a few additional components are required to effect the complete conversion of any one particular system to any of the other control systems.

Figure 15:
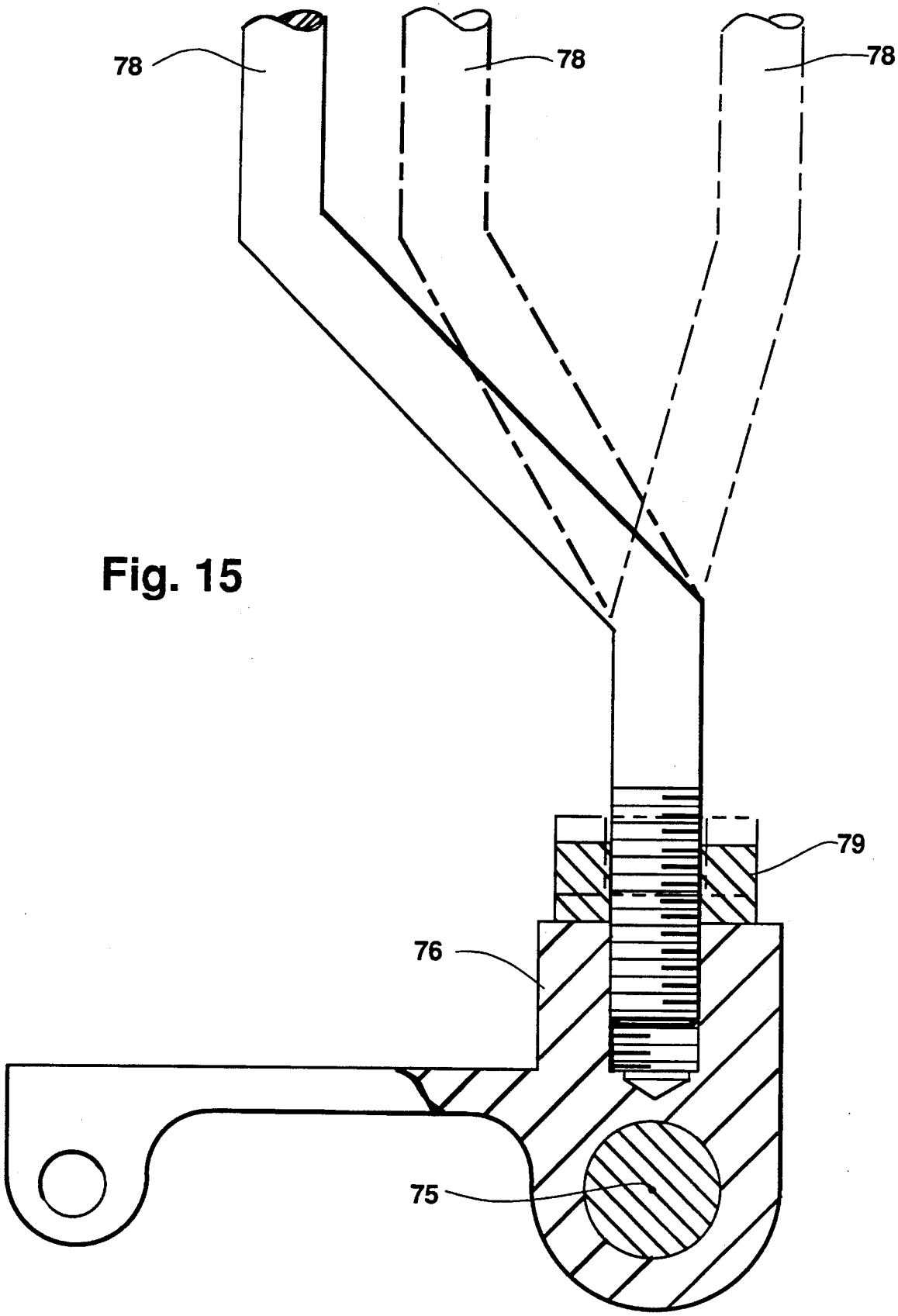
FIG. 15 is an enlarged detailed view of the control lever, with representative pivotable positions of the control lever being shown in phantom.

As can best be seen in FIG. 15, each control handle in each of the embodiments depicted in FIGS. 4–14 is constructed with a bent control rod 78 terminating with a handle **78*a* for engagement thereof by the operator. The control rod 78 is threadably received in a pivot casting 76, which in turn is pivotally mounted for operable movements as described above in greater detail. A lock nut 79 threaded onto the control rod 78 can be engaged against the pivot casting 76 to lock the control rod 78 from rotational movement relative to the pivot casting 76**.

Accordingly, each particular control lever is repositionable by a loosening of the corresponding lock nut 79 and a subsequent rotation of the control rod 78 to orient the control rod 78 and position the handle **78*a* in a position conforming to the standard configuration of the selected control mechanism system. This particular control lever construction facilitates the conversion of the backhoe control mechanism from one type of system to another type of system by permitting the control lever handle 78*a*** to be oriented in a customary manner, which is different with each respective type of control system.

The method of converting one control system to either of the other control systems is simple and easy to accomplish. For example, the conversion of a three lever system to a four lever control system would not require a reconfiguration of the hydraulic valve to correspond to the function of the levers in the four lever control mechanism. The conversion would require the mounting of a fourth control lever for pivotal movement about the first pivot axis 75, then reconnecting the various linkage members into the configuration described above so that each control lever 131–134 will operate the spool corresponding to the function typically associated with the respective control levers of the four lever system.

The transverse transfer of motion from a control lever to a corresponding spool spaced transversely therefrom can be accomplished in at least two ways. As noted above, a special bell crank can be utilized, as well as a transfer of pivotal motion directly by the pivot shaft from one pivot arm fixed to the shaft to a second pivot arm also fixed to the shaft at a location transversely spaced from the first pivot arm. The use of the pivot shaft to transfer pivotal motion requires that any other pivot shafts or bell cranks mounted on that pivot shaft be mounted for rotational movement independently of that pivot shaft.

The conversion of a two lever system to either the three or four lever control system is done similarly to that described above. However, the control levers must be mounted directly on the pivot shaft corresponding to the first pivot axis for movement only in a fore-and-aft direction. Accordingly the supplemental pivot castings 81 would be discarded, while one or two additional control levers are mounted for longitudinal movement about the first pivot axis 75. The addition of appropriate bell cranks and pivot arms permit the various control levers to be connected to the appropriate valve spool to effect control of the function typically associated with the respective control lever. If the three lever system is utilized, additional foot pedal linkage must also be mounted and connected with the appropriate spool as is described in greater detail above.

The provision of pivot arms and bell cranks on the pivot shaft corresponding to the second pivot axis 90 allows the respective control levers to be connected to the proper valve spool so that the control lever can operate the customary function associated with that particular control lever, irrespective of the type of control system being utilized, without requiring the restacking or reconfiguration of the hydraulic control valve so that the spools line up vertically with the function associated with each respective control lever.

It will be understood that changes in the details, materials, steps, and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description may be employed in other embodiments without departing from the scope of the invention. Accordingly, the following claims are intended to protect the invention broadly as well as in the specific form shown.

Having thus described the invention, what is claimed is:

1. In a backhoe having a prime mover including a wheeled frame and an operator's cab mounted on said frame; an articulated boom assembly pivotally connected to said frame for movement about a generally vertical axis, said boom assembly having a mounting member pivotally supported from said frame, a boom member pivotally connected to said mounting member for movement about a generally horizontal axis carried by said mounting member, a dipper member pivotally connected to said boom member for movement in a generally vertical plane relative to said boom member, and a working tool pivotally connected to a distal end of said dipper member and being movable in a generally vertical plane relative to said dipper member; a hydraulic system operably associated with said boom assembly to effect the articulated movements thereof and to effect movement of said boom assembly about said generally vertical axis, said hydraulic system including a swing hydraulic cylinder interconnecting said frame and said mounting member to effect pivotal movement thereof about said generally vertical axis, a boom hydraulic cylinder interconnecting said mounting member and said boom member to effect pivotal movement of said boom member in said generally vertical plane, a dipper hydraulic cylinder interconnecting said boom member and said dipper member to effect pivotal movement of said dipper member relative to said boom member, and a bucket cylinder operatively interconnecting said dipper member and said working tool to effect pivotal movement thereof relative to said dipper member, said hydraulic system further including a source of hydraulic fluid under pressure in flow communication with each of said hydraulic cylinders to power the operation thereof and a hydraulic valve body having a movable spool associated with each said hydraulic cylinder to control the flow of hydraulic fluid thereto; and a control mechanism operatively associated with said hydraulic system to control the flow of said hydraulic fluid under pressure to said hydraulic cylinders to power the operation thereof by controlling the movement of said spools, an improved control mechanism comprising:

a plurality of control levers pivotally mounted for movement about a first pivot axis, some of said spools associated with the hydraulic cylinders to be controlled with the pivotal movement of a corresponding control lever being transversely displaced relative to the plane of pivotal movement of said corresponding control lever;

a plurality of linkage members pivotally supported for movement about a second pivot axis vertically spaced below said first pivot axis, selected ones of said linkage members being operable to transfer movement of a selected said control lever to actuate a corresponding said spool spaced transversely of the plane of movement of said selected said control lever, said linkage members being selectively positionable along said second pivot axis to permit each said control lever to effect actuation of a selected one of said spools; and links interconnecting said control levers, said linkage members, and said spools to effect movement of each of said spools in response to the movement of the selected corresponding said control lever, thereby permitting said control mechanism to be selectively converted between configurations comprising two levers, three levers and four levers by adding or removing the additional levers along the first axis and connecting or unconnecting the appropriate linkage members and links between the levers and spools without changing the orientation of the spools.

2. The backhoe of claim 1 wherein said linkage members include a pair of transversely spaced pivot arms affixed to a pivot shaft defining said second pivot axis such that a pivotal movement of one of said control levers causes a corresponding pivotal movement of said pivot arms and said pivot shaft to transfer the pivotal movement of said one control lever transversely to the corresponding spool transversely displaced relative to the plane of pivotal movement of said one control lever.

3. The backhoe of claim 1 wherein said linkage members include a bell crank having a pair of transversely spaced arms rigidly affixed relative to one another to transfer pivotal movement of one of said control levers transversely of the plane of movement of said one control lever to effect movement of the corresponding spool displaced transversely from said plane of movement of said one control lever.

4. The backhoe of claim 2 further including a pair of transversely located outrigger stabilizers pivotally supported from said frame and movably powered by a pair of corresponding stabilizer hydraulic cylinders operably controlled from corresponding spools forming part of said hydraulic valve body, said control mechanism including a pair of control levers pivotally supported for movement about said second pivot axis.

5. In a backhoe having a prime mover including a wheeled frame and an operator's cab mounted on said frame; an articulated boom assembly pivotally connected to said frame for movement about a generally vertical axis, said boom assembly having a mounting member pivotally supported from said frame, a boom member pivotally connected to said mounting member for movement about a generally horizontal axis carried by said mounting member, a dipper member pivotally connected to said boom member for movement in a generally vertical plane relative to said boom member, and a working tool pivotally connected to a distal end of said dipper member and being movable in a generally vertical plane relative to said dipper member; a hydraulic system operably associated with said boom assembly to effect the articulated movements thereof and to effect movement of said boom assembly about said generally vertical axis, said hydraulic system including a swing hydraulic cylinder interconnecting said frame and said mounting member to effect pivotal movement thereof about said generally vertical axis, a boom hydraulic cylinder interconnecting said mounting member and said boom member to effect pivotal movement of said boom member in said generally vertical plane, a dipper hydraulic cylinder interconnecting said boom member and said dipper member to effect pivotal movement of said dipper member relative to said boom member, and a bucket cylinder operatively interconnecting said dipper member and said working tool to effect pivotal movement thereof relative to said dipper member, said hydraulic system further including a source of hydraulic fluid under pressure in flow communication with each of said hydraulic cylinders to power the operation thereof and a hydraulic valve body having a movable spool associated with each said hydraulic cylinder to control the flow of hydraulic fluid thereto; and a control mechanism operatively associated with said hydraulic system to control the flow of said hydraulic fluid under pressure to said hydraulic cylinders to power the operation thereof by controlling the movement of said spools, an improved control mechanism comprising:

a plurality of control levers pivotally mounted for movement about a first pivot axis, some of said spools associated with the hydraulic cylinders to be controlled with the pivotal movement of a corresponding control lever being transversely displaced relative to the plane of pivotal movement of said corresponding control lever;

a plurality of linkage members pivotally supported for movement about a second pivot axis vertically spaced below said first pivot axis;

links interconnecting said control levers, said linkage members, and said spools to effect movement of each of said spools in response to a corresponding movement of a selected one of said control members; and a pair of transversely located outrigger stabilizers pivotally supported from said frame and movably powered by a pair of corresponding stabilizer hydraulic cylinders operably controlled from corresponding stabilizer spools forming part of said hydraulic valve body, a pair of said control levers being operably coupled to said stabilizer spools and pivotally supported for movement about said second pivot axis.

* * * * *